US005285036A

United States Patent [19]

Lorenz

[11] Patent Number: 5,285,036

[45] Date of Patent: Feb. 8, 1994

[54] GAS-DRIVEN POWER SWITCH WITH POWER-ASSISTED PISTON

[75] Inventor: Dieter Lorenz, Berlin, Fed. Rep. of Germany

[73] Assignee: Siemens Aktiengesellschaft, Munich, Fed. Rep. of Germany

[21] Appl. No.: 927,475

[22] PCT Filed: Feb. 12, 1991

[86] PCT No.: PCT/DE91/00114

§ 371 Date: Nov. 25, 1992

§ 102(e) Date: Nov. 25, 1992

[87] PCT Pub. No.: WO91/15025

PCT Pub. Date: Oct. 3, 1991

[30] Foreign Application Priority Data

Mar. 26, 1990 [DE] Fed. Rep. of Germany ..... 4010007

[51] Int. Cl.[5] ..... H01H 33/88

[52] U.S. Cl. ..... 200/148 A

[58] Field of Search ..... 200/148 R, 148 A, 148 B

[56] References Cited

U.S. PATENT DOCUMENTS 4,041,263 8/1977 Noeske ..... 200/148 A 4,438,308 3/1984 Korner et al. ..... 200/148 A

FOREIGN PATENT DOCUMENTS 678029 7/1939 Fed. Rep. of Germany .

1295049 5/1969 Fed. Rep. of Germany .

3141324 6/1986 Fed. Rep. of Germany .

3618345 12/1987 Fed. Rep. of Germany .

2080625 2/1982 United Kingdom .

*Primary Examiner*—J. R. Scott

*Attorney, Agent, or Firm*—Kenyon & Kenyon

[57] ABSTRACT

A gas-blast circuit-breaker having an actuated compression cylinder may include a reinforced actuation of the compression piston through the magnetic effect of the breaking current. A hollow-cylindrical body of ferromagnetic material concentrically surrounds a stationary contact member and is rigidly coupled to the compression cylinder. The hollow-cylindrical body has at least one slot in which a piston rod of the compression piston is guided. One section of the piston rod consists of ferromagnetic material. As soon as a small portion of this section enters into the slot, it is pulled into the slot by the magnetic effect of the breaking current. As a result, the compression piston is accelerated in a direction opposite the movement of the compression cylinder. Thus, the maximum quenching gas pressure is reached sooner than it would have been with a sole actuation of the compression cylinder. The gas-blast circuit breaker is intended to be used as a puffer circuit-breaker, in particular an $SF_6$ circuit-breaker.

8 Claims, 2 Drawing Sheets

GAS-DRIVEN POWER SWITCH WITH POWER-ASSISTED PISTON

BACKGROUND OF THE INVENTION

The present invention relates to a gas-blast circuit-breaker including at least one stationary and one movable contact member. Additionally, the circuit-breaker includes a compression device, which consists of one actuated compression cylinder that is coupled to the movable contact member and one compression piston that is actuated during the breaking movement oppositely to the compression cylinder. The compression cylinder and the compression piston enclose a compression space. A mechanical limit stop restricts the movement of the compression piston on its side facing away from the compression space and a restoring device pulls the piston rod of the compression piston nearer to the limit stop. The circuit-breaker also includes a device for reinforcing the actuation through the magnetic effect of the breaking current.

In a gas-blast circuit-breaker having a mechanical compression device for the quenching gas including an actuated compression cylinder and a compression piston, the quenching gas is compressed in the compression space and is used after that to blow out the electric arc that is formed when the switch is switched off. In addition to driving the compression cylinder, it is also generally known to drive the compression piston oppositely to the cylinder, in order to more quickly attain a high quenching gas pressure.

German Patent No. 31 41 324 discloses a gas-blast circuit-breaker having a mechanical compression device for the quenching gas, in which the compression piston is actuated in a direction opposite the movement of the compression cylinder, and in which the compression piston consisting of ferromagnetic material is actuated by a magnetic field generated by a coil that is disposed coaxially to the compression piston. The winding density of the coil is variable along its longitudinal axis, so that a uniform gradient field results. During the breaking movement, the coil is traversed by the flow of the breaking current and the compression piston is actuated by the action of magnetic force. German Patent Document No. C-678 029 describes a controlling system for an electric gas switch. This controlling system is supposed to control the gas flow of the quenching gas generated in the switch itself by the action of the electric arc on a material that gives off quenching gas. The control member, namely the sliding cylindrical valve, is adjusted by the magnetic effect of the breaking current. U S. Pat. No. 4,041,263 discloses a gas-blast circuit-breaker, in which a force generated by the magnetic effect of the breaking current acts on the piston of the compression device to reinforce the actuation. For this purpose, the breaking current is carried via a conductor loop that runs in part through the movable piston. This necessitates transmitting the current via sliding contacts. Moreover, the complicated current conduction requires that the movable contact member be coupled to the driving mechanism with insulation.

SUMMARY OF THE INVENTION

The present invention relates a gas-blast circuit-breaker in which the compression piston can be actuated by the magnetic effect or the breaking current while maintaining the expenditure for design and the space requirements for the piston's driving device as low as possible.

The present invention includes the following features the contact members are surrounded at least in part by a hollow-cylindrical body, which consists at least partially of ferromagnetic material and whose ferromagnetic portion has at least one continuous slot that runs parallel to the direction of the breaking current;

at least one rod consisting partially of ferromagnetic material is provided, which is capable of being introduced in the longitudinal direction into one of the slots; and in that one of the two portions of the compression device is rigidly coupled to the hollow-cylindrical body and the other portion is rigidly coupled to the rod(s).

A gas-blast circuit-breaker according to the present invention takes advantage of the fact that the breaking current flowing through a contact member builds up a surrounding magnetic field that is concentric to this contact member. The hollow-cylindrical body of ferromagnetic material is configured in this magnetic field. It has at least one continuous slot that runs parallel to the direction of the breaking current. The magnetic flux within the ferromagnetic material encounters considerable resistance at this slot. A ferromagnetic rod, situated in part in a slot of the hollow-cylindrical body, is pulled into the slot by the magnetic force. Since one of the two parts of the compression device is rigidly coupled to the hollow-cylindrical body and the other is rigidly coupled to the rod(s), the compressional movement of the compression cylinder and the compression piston are reinforced by the dynamic magnetic effect of the breaking current. The advantage of this construction is that it is especially compact, since the device for magnetically reinforcing the actuation can be arranged in the elongation of the compression cylinder. Consequently, no additional parts need to be secured to the periphery of the compression cylinder. The magnetic driving force is dependent upon the breaking current and has virtually no effect when there are low breaking currents. Therefore, when a low current is interrupted, this current is not interrupted because of too strong a blow-out before current zero. A magnetically reinforced actuation makes it possible for one to increase the efficiency of the gas-blast circuit-breaker without having to enlarge the conventional driving mechanism for the switch. When the level of efficiency is kept constant, the conventional switch mechanism can be made smaller to economize on costs.

Since a hollow-cylindrical body made partially of ferromagnetic material will normally be much heavier than rods made of ferromagnetic material, it is advantageous for the compression cylinder to be rigidly coupled to the hollow-cylindrical body and, accordingly, the compression piston to the rod(s). In this manner, the mass to be accelerated with the compression piston is kept small, in order to achieve a high rate of acceleration of the compression piston. As a result, the maximum quenching gas pressure is attained very early on during the breaking movement.

To guarantee a good guidance for the compression piston it is equipped with a piston rod that consists of ferromagnetic material in one section of its length. The piston rod is guided during the breaking movement in a slot of the hollow-cylindrical body and can be introduced into this slot to the extent that the ferromagnetic section of the piston rod also enters into the slot. Since the piston rod is constantly guided in the slot, special precautions are not needed to avoid an offset between the piston rod and the slot during the breaking movement. Moreover, this guidance additionally secures the piston, which is movable in the compression cylinder, to prevent it from becoming skewed. As soon as the ferromagnetic section of the piston rod enters into a slot of the hollow-cylindrical body, the magnetic forces, which pull this section of the piston rod into the slot, become effective. As a result, an additional driving force is transferred to the piston rod and, consequently, to the compression piston. In the closed-circuit condition of the circuit-breaker, the ferromagnetic section of the piston rod is arranged in relation to the hollow-cylindrical body in such a way that when it enters into a slot of the hollow-cylindrical body in the course of the breaking movement, the compression piston is driven in a direction opposite the movement of the compression cylinder.

This can be guaranteed, for example, by arranging the ferromagnetic section of the piston rod on the side of the piston facing the compression space and by securing the hollow-cylindrical body inside the compression space to the compression cylinder. This configuration represents a particularly compact design, since no additional component parts are needed outside of the compression device. Therefore, the space requirements are reduced compared to the known gas-blast circuit-breaker.

If space inside the compression cylinder is not sufficient to install the hollow-cylindrical body, it is recommended that the ferromagnetic section of the piston rod be arranged on the side of the piston facing away from the compression space and that the hollow-cylindrical body be secured outside of the compression cylinder on its base facing away from the compression space.

In both mentioned specific embodiments, it is advantageous for the section of the piston rod consisting of ferromagnetic material to be arranged relative to the hollow-cylindrical body so that it will enter into a slot of the hollow-cylindrical body during the breaking operation only after it has covered a certain distance. This ensures that still no force will act on the compression piston in the closed-circuit condition. Moreover, this construction assures that when the switch is switched on the instant a pre-arc is struck, the ferromagnetic section of one piston rod has already completely or almost completely left the slot in the hollow-cylindrical body. In this manner the piston rod, together with the compression piston, cannot be taken along by the compression cylinder during the closing movement. Due to the inertia of the compression piston mass, the piston rod is not taken along, even when there is residual overlapping of a ferromagnetic section of one piston rod with one of the slots the instant a pre-arc is struck, and it can be retracted by a restoring spring to the mechanical limit stop.

In this connection, it can also be advantageous to connect the compression cylinder to partially ferromagnetic rods, which enter into slots of a hollow-cylindrical body of ferromagnetic material coupled to the compression piston. Since as a rule, the mass of a hollow-cylindrical body of partially ferromagnetic material is greater than the mass of partially ferromagnetic rods that are drawn into the slots of the body, the mass to be accelerated by the compression piston is enlarged with this type of design, thus making it more difficult for the compression piston to be taken along during the closing movement.

The restoring device for the compression piston consists advantageously of one spring, whose strength is selected, on the one hand, so as to allow the piston rod to be pulled back reliably to the limit stop in the closed-circuit condition, however, on the other hand, so as not to prevent the movement of the compression piston during the breaking movement.

The hollow-cylindrical body has an especially simple design when it is comprised of two hollow half cylinders made of ferromagnetic material with two slots formed between them and of one supporting structure of non-ferromagnetic material that supports the hollow half cylinder. This design guarantees that the magnetic flux between the two hollow half cylinders is interrupted by the slots formed between them and also that no magnetic closing contact is made between the hollow half cylinders across the supporting structure. The two hollow half cylinders can be secured, for example, to the surface area of a hollow cylinder made of plastic. Hollow half cylinders are also understood to be those parts, which are not necessarily able to be combined to form a full circular hollow cylinder, but rather leave open the mentioned slots between them when they are put together.

The present invention will be presented in the following on the basis of two exemplified embodiments portrayed in the drawings and subsequently described. The present invention is not restricted thereby to the applications indicated by the exemplified embodiments.

DETAILED DESCRIPTION

Figure 1:
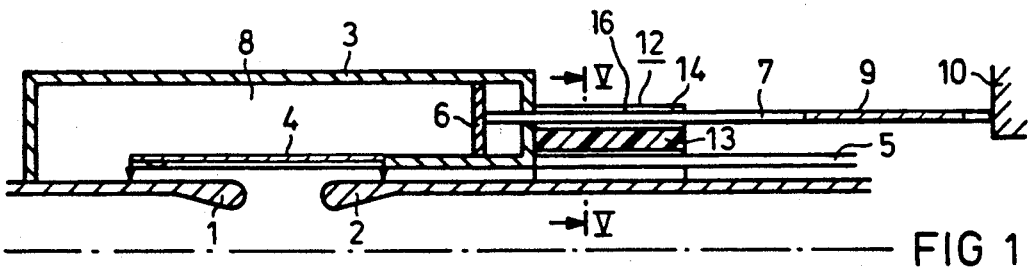
FIGS. 1 through 4 illustrates a portion of a gas-blast circuit-breaker shown in longitudinal section, in four different phases during the breaking movement.
Figure 2:
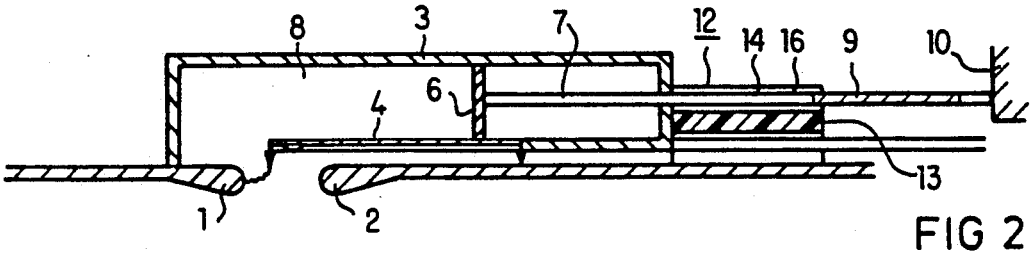
Figure 3:
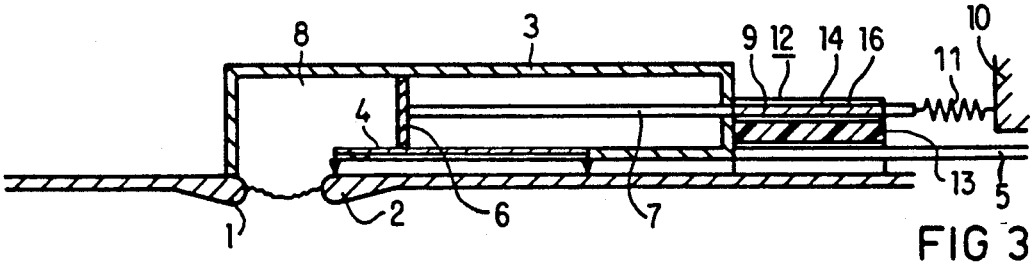
Figure 4:
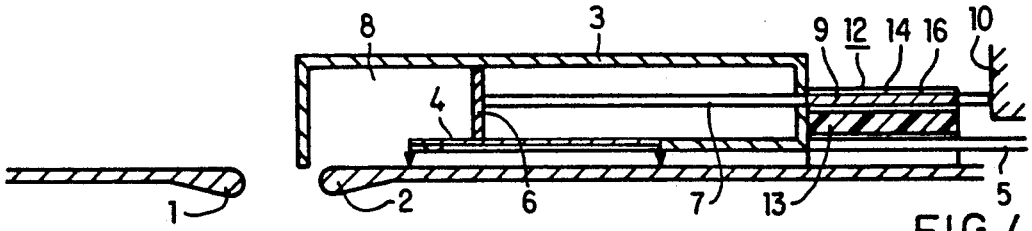
Figure 5:
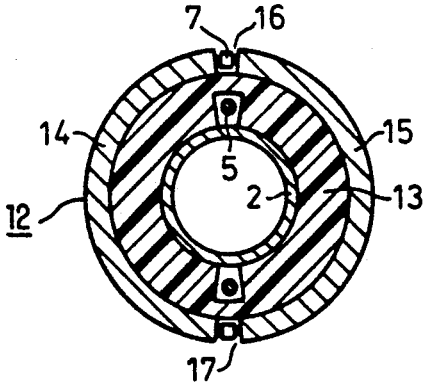
FIG. 5 illustrates the gas-blast circuit-breaker from FIGS. 1 through 4 in the cross-section V—V indicated in FIG. 1.
Figure 6:
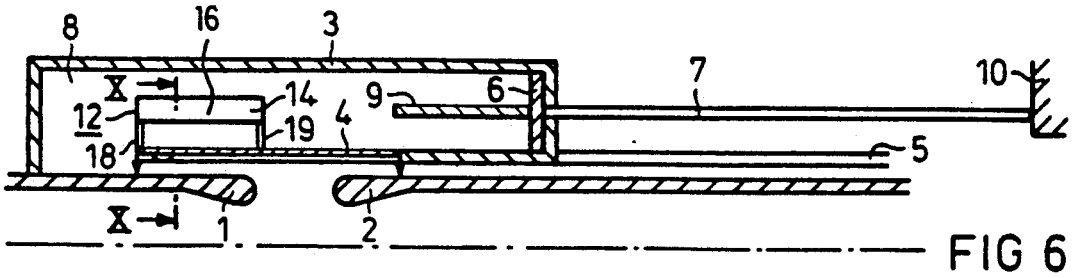
FIGS. 6 through 9 illustrates a portion of another gas-blast circuit-breaker in a longitudinal section, in four different phases during the breaking movement.
Figure 7:
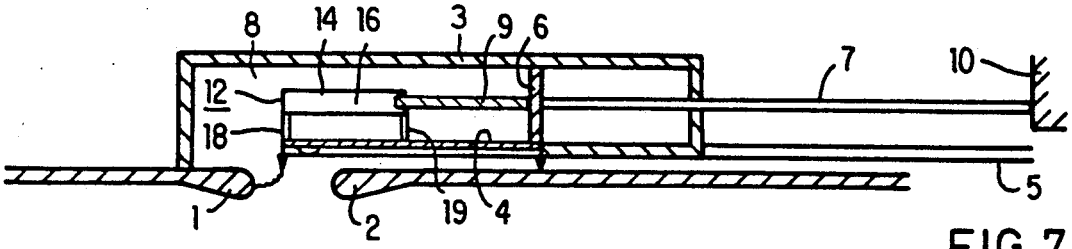

In the first exemplified embodiment illustrated in FIGS. 1-5, the high-voltage gas-blast circuit-breaker has two hollow, nozzle-shaped contact members 1, 2, which oppose one another coaxially. The two stationary contact members 1, 2 are surrounded by the compression cylinder 3, which is permanently coupled to a movable contact member 4. The compression cylinder 3 is coupled via an actuating rod 5 to a conventional driving device that is not shown.

The compression piston 6, which is provided with a piston rod 7, 9, is designed to be movable in the longitudinal direction of the piston rod 7, 9. The piston 6 abuts sealingly on the walls of the compression cylinder 3 and, together with this compression cylinder, encloses the compression space 8. The piston rod 7, 9 consists in a section 9 of its length of ferromagnetic material. The end of the piston rod 7, 9 facing away from the compression space 8 abuts on a mechanical limit stop 10, which restricts the movement of the piston. Situated between the limit stop 10 and the piston rod 7, 9 is a spring 11 illustrated in FIG. 3, which pulls the piston rod 7, 9 nearer to the limit stop 10.

In the closed-circuit condition of the gas-blast circuit-breaker, the movable contact member 4 electro-conductively jumpers the two stationary contact members 1, 2. During the breaking operation, the driving mechanism pulls the compression cylinder 3 and, along with it, the movable contact member 4 by means of the actuating rod 5 in such a way over the piston 6, that the compression space 8 is made smaller and the movable contact member 4 runs off the stationary contact member 1. The piston 6 is pressed by the pressure of the quenching gas prevailing in the compression space 8 in the direction of the limit stop 10, which limits the movement of the piston 6 by means of the piston rod 7, 9.

A hollow-cylindrical body 12 is secured to the outer end face of the compression cylinder 3 facing the limit stop 10. This body 12 consists of a plastic hollow cylinder 13 that concentrically surrounds the stationary contact member 2 and of two hollow half cylinders 14, 15 of ferromagnetic material, in particular iron, which are secured to the surface area of the plastic hollow cylinder 13 in such a way that, between them, they form two continuous slots 16, 17. These slots 16, 17 each serve as pass-through openings for one piston rod 7, 9.

A magnetic field that is concentric to the contact member 2 is produced in the two hollow half cylinders 14, 15 of ferromagnetic material, for as long as the breaking current flows through the stationary contact member 2. Since the magnetic closing contact between the two hollow half cylinders 14, 15 is interrupted by the slots 16, 17, the ferromagnetic section 9 of the piston rod 7, 9 is pulled into the slot after entering into one of the slots 16, 17 by the action of the magnetic force.

To reliably avoid a magnetic closing contact between the ferromagnetic section 9 of one piston rod 7, 9 and one of the hollow half cylinders 14, 15, guide elements (not shown) of non-ferromagnetic material are provided, for example non-ferromagnetic rolling elements. These elements are flush mounted in the lateral surfaces of the hollow half cylinders 14, 15, which delimit the slots 16, 17. These rolling elements enable each piston rod 7, 9 to be guided without making contact in one slot 16, 17.

As soon as the magnetic force acting on the piston 6 exceeds the force acting on the piston 6 because of the pressure prevailing in the compression space 8, the piston 6 is accelerated in a direction opposite the movement of the compression cylinder 3. The result is that the compression operation accelerates, and the maximum quenching gas pressure is reached sooner than it would have been without an additional actuation of the compression piston 6. Therefore, due to the short amount of time involved, it is hardly possible for the quenching gas to escape by leaking out of the compression cylinder 3 before the maximum quenching gas pressure is reached.

When the breaking current is too low to generate a great enough force on the compression piston 6 to exceed the force that results from the quenching gas pressure and acts on the piston 6, the piston 6 is not accelerated and the magnetic reinforcement of the actuation is reduced. Therefore, given low breaking currents, one does not need to fear that the current will be interrupted before the current zero crossing as the result of too strong a blowout.

The ferromagnetic section 9 of the piston rod 7, 9 is arranged in such a way that it is already situated mostly outside of the slot 16 of the hollow-cylindrical body 12 during a closing movement at the instant when the first pre-arc is struck. The short period of time in which magnetic force acts on the piston rod 7, 9 does not suffice to overcome the mass inertia of the piston 6 as well as the restoring force of the spring 11 to the extent that the piston 6 would be taken along by the actuated compression cylinder 3.

Figure 8:
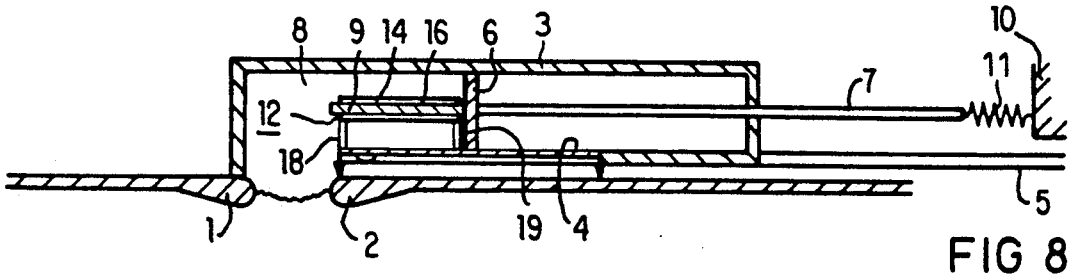
Figure 9:
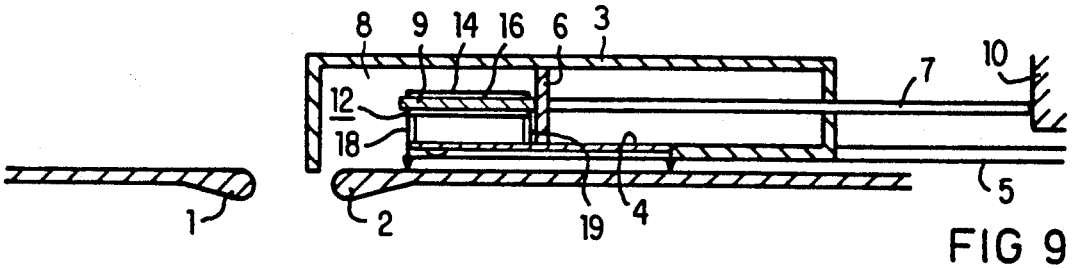
Figure 10:
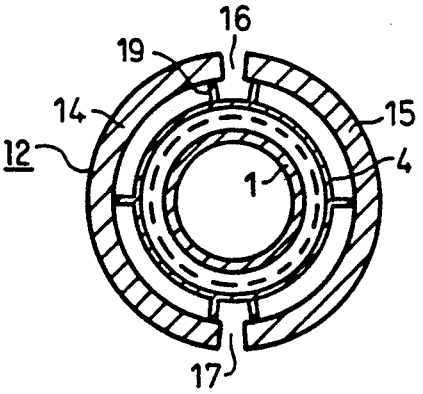
FIG. 10 illustrates the gas-blast circuit-breaker from FIGS. 6 through 9 in the cross-section X—X indicated in FIG. 6.

Another exemplified embodiment of the present invention is shown in FIGS. 6 through 10. The same element in FIGS. 8–10 are provided with the same reference numbers as in FIGS. 1 through 5.

In the case of this gas-blast circuit-breaker, the configuration of the stationary contact members 1, 2 and of the movable contact member 4 with the compression cylinder 3 surrounding them corresponds to the exemplified embodiment of FIGS. 1 through 5 described above. The specific embodiments differ in the configuration of the hollow-cylindrical body 12 and in the design of the piston rod 7, 9.

The piston rod 7, 9 extends on both sides of the piston 6. The ferromagnetic section 9 of the piston rod 7, 9 is situated on the side of the piston 6 facing the compression space 8. The hollow-cylindrical body 12 is arranged inside the compression space and is secured to the movable contact member 4 by means of braces 18, 19. In this manner, the flow of the quenching gas inside the compression space 8 is not impeded any more than necessary. The ferromagnetic section 9 of the piston rod 7, 9 first enters into the slot 16 of the hollow-cylindrical body 12 when the movable contact member 4 has run off the stationary contact member 1. The effect of this arrangement is that when the switch is switched on, the ferromagnetic section 9 of the piston rod 7, 9 leaves the slot 16 in the hollow-cylindrical body 12 early enough so as not to be taken along by the movement of the compression cylinder 3. After each switch movement, the piston rod 7, 9 is again by the spring 11 into its position of rest towards the mechanical stop 10.

On the other hand, in the case of a breaking operation, from the instant the ferromagnetic section 9 of the piston rod 7, 9 enters in the slot 16, the actuation is magnetically reinforced. If the breaking current is great enough, the piston 6 is accelerated in a direction opposite that of the compression cylinder 3, through which means the maximum quenching gas pressure is reached sooner than it would have been without the additional actuation of the piston 6. In the further course of the compressional movement, the electric arc is then blown out with the compressed quenching gas, and the compression piston 6 is moved along further, together with the compression cylinder 3, until it strikes against the limit stop 10. In this position, the switch has reached its limit position.

What is claimed is:

1. A gas-blast circuit-breaker comprising:

at least one stationary contact member and one moveable contact member;

a compression device including one actuated compression cylinder that is coupled to the one moveable contact member and one compression piston that is actuated during a breaking movement in the opposite direction to the compression cylinder, whereby the compression cylinder and the compression piston enclose a compression space;

a mechanical limit stop for restricting movement of the compression piston on a side of the compression piston facing away from the compression space;

a restoring device connected to the compression piston and pulling the piston rod of the compression piston nearer to the mechanical limit stop;

a device for reinforcing actuation through the magnetic effect of the breaking current;

a hollow-cylindrical body surrounding a portion of said at least one stationary contact member and said one moveable contact member, said hollow-cylindrical body having a portion consisting of ferromagnetic material, said ferromagnetic portion having at least one continuous slot that runs parallel to the direction of the breaking current; and at least one rod consisting partly of ferromagnetic material which is introduced in the longitudinal direction into one of the slots;

wherein one of the compression cylinder and the compression piston is rigidly coupled to the hollow-cylindrical body and the other of the compression cylinder and the composition piston is rigidly coupled to said at least one rod.

2. The gas-blast circuit-breaker according to claim 1, wherein the compression cylinder is rigidly coupled to the hollow-cylindrical body.

3. The gas-blast circuit-breaker according to claim 2, wherein the piston rod includes one section of its length consisting of ferromagnetic material and the piston rod is introduced during the breaking movement into one of said slots of the hollow-cylindrical body such that the ferromagnetic section of the piston rod enters into said one of said slots.

4. The gas-blast circuit-breaker according to claim 3, wherein the ferromagnetic section of the piston rod is arranged on a side of the compression piston facing the compression space and that the hollow-cylindrical body is secured inside the compression space to the compression cylinder.

5. The gas-blast circuit-breaker according to claim 3, wherein the ferromagnetic section of the piston rod is arranged on the side of the piston facing away from the compression space and the hollow-cylindrical body is secured outside of the compression cylinder on its base facing away from the compression space.

6. The gas-blast circuit-breaker according to claim 3, wherein the section the section of the piston rod consisting of ferromagnetic material is arranged relative to the hollow-cylindrical body so that it will enter into one of said slots of the hollow-cylindrical body during the breaking operation only after it has covered a certain distance.

7. The gas-blast circuit-breaker according to claim 1, wherein the restoring device comprises a spring.

8. The gas-blast circuit-breaker according to claim 1, wherein the hollow-cylindrical body comprises two hollow half cylinders made of ferromagnetic material with two slots formed between them and one cylindrical supporting structure of non-ferromagnetic material, the two hollow half cylinders being fixed to a cylindrical outer surface of the cylindrical supporting structure.

* * * * *